United States Patent [19]

Kull

[11] 4,154,282

[45] May 15, 1979

[54] METHOD OF CASTING METAL AROUND A GEM TO FORM ARTICLES OF JEWELRY

[75] Inventor: Herbert Kull, Neuenbürg-Arnbach, Fed. Rep. of Germany

[73] Assignee: J. E. Hammer & Söhne, Pforzheim, Fed. Rep. of Germany

[21] Appl. No.: 798,099

[22] Filed: May 17, 1977

[30] Foreign Application Priority Data

May 24, 1976 [DE] Fed. Rep. of Germany ..... 2623192

[51] Int. Cl.[2] ..... B22C 7/02; B22C 9/04

[52] U.S. Cl. ..... 164/9; 63/27; 164/34; 264/221; 264/227

[58] Field of Search ..... 63/2, 26, 28, 27; 164/34, 35, 8, 15, 9, 45; 264/DIG. 55, 221, 227

[56] References Cited

U.S. PATENT DOCUMENTS

| | | | |
|---|---|---|---|
| 1,997,500 | 4/1935 | Swarovski | 63/28 |
| 2,163,814 | 6/1939 | Swarovski | 63/28 |
| 2,790,220 | 4/1957 | Fox | 164/35 |
| 2,887,746 | 5/1959 | Bogoff | 164/9 |
| 3,114,948 | 12/1963 | Poe | 164/35 |
| 3,910,066 | 10/1975 | Strack | 63/26 |
| 4,008,052 | 2/1977 | Vishnevsky et al. | 164/100 |

FOREIGN PATENT DOCUMENTS

| | | | |
|---|---|---|---|
| 363959 | 3/1906 | France | 63/26 |
| 1221561 | 6/1960 | France | 63/26 |

*Primary Examiner*—James B. Lowe
*Attorney, Agent, or Firm*—Michael J. Striker

[57] ABSTRACT

A preform mold space is formed by two mold sections spaced from each other. A gem is positioned in the mold space, and a hardenable preform wax-like material is introduced into the mold space and into supporting contact with the gem to thereby form a preform model upon hardening of the wax-like material. The preform model is removed from the mold space and embedded in hardenable embedding material so as to form a mold cavity about the exterior of the preform model upon hardening of the embedding material. Simultaneously with the hardening process the wax-like material is melted and removed from the mold cavity while the gem remains embedded in the mold. A heated molten hardenable metal material is then introduced into the mold cavity. The hardened metal material supportingly engages different facets of the gem and fixedly anchors the latter in the article of jewelry formed by the disclosed method.

4 Claims, 5 Drawing Figures

METHOD OF CASTING METAL AROUND A GEM TO FORM ARTICLES OF JEWELRY

BACKGROUND OF THE INVENTION

The present invention generally relates to articles of jewelry and, more particularly, to a method of setting a gem in such articles.

It has been proposed in the jewelry industry to mass produce articles of jewelry by casting gem supports such as rings out of metal material. Sand-casting techniques have been used and recently centrifugal-casting techniques have likewise been employed. The latter technique provides a very dense structure whose outer surface for the gem support is smooth and can therefore satisfy strict plating requirements.

Generally the proposed centrifugal-casting techniques include the formation of a plurality of preform wax models which are all arranged and interconnected on a so-called wax tree-like structure. The tree-like structure is then embedded by hardenable embedding material contained in a treatment vessel. The embedding material hardens to form a mold cavity in a burning process. Simultaneously with this hardening process the wax model is melted and removed from the mold cavity. Thereupon heated molten metal material is introduced into the mold cavity. After hardening of the metal material the embedding material is broken away, the cast gem support is ready to be set with a gem.

This known burning process takes about ten hours to complete, and about three-fourths of this time is wasted in preheating to temperatures of about 700° C. subsequently the centrifugal-casting of the fluid molten metal material whose temperature is approximately 1100° C. follows at about the same temperature of the treatment vessel. After a certain cooling-down period has elapsed, the treatment vessel is water-quenched to a still relatively high temperature.

The manufacture of the preform wax models is formed in resilient rubber-type molds having negative patterns whose contours are complementary to the gem support to be cast. The molds may be adapted to form gem supports having apertures or projections or relatively narrow branches as, for example, provided in chaton- or corner-type settings.

The cast gem supports are provided with holding elements such as stubs, fingers, corners or frames. A jeweler must manually place a gem in position on the cast gem support and thereupon fixedly anchor the gem in place, for example by bending a finger-type holding element over a facet of the gem.

However, this type of manual setting procedure is unsatisfactory. A great deal of skill is required for the jeweler to properly orient the gam and to subsequently anchor it in place. A great deal of time is lost in completing the jewelry article. These requirements make the total cost of manufacture relatively high. In the case of high-quality, expensive jewelry articles, a jeweler must be particularly skillful in setting the gem. Such rigid quality control means, of course, additional expenses.

SUMMARY OF THE INVENTION

Accordingly, it is the general object of the present invention to overcome the disadvantages of the prior art.

An additional object of the present invention is to provide a novel method of setting a gem in an article of jewelry which is particularly well suited for mass-production techniques.

Still another object of the present invention is to substantially reduce the time required for setting a gem in an article of jewelry.

Yet another object of the present invention is to reduce the costs of manufacture of an article of jewelry.

In keeping with these objects and others which will become apparent hereinafter, one feature of the invention resides, briefly stated, in a method of setting a gem in an article of jewelry which comprises the steps of positioning the gem in a mold cavity, and introducing hardenable jewelry material into the mold cavity and into supporting contact with the gem to thereby form, upon hardening of the hardenable jewelry material, an article of jewelry in which the gem is fixedly anchored by the hardened jewelry material.

In accordance with the invention, the hardenable jewelry material is automatically cast at different portions of the facets of the gem. The gem is fixedly anchored without requiring a skilled artisan to position and manually bend a finger-type holding element over the gem. Thus the costs of setting a gem are significantly reduced. The strict quality control required heretofore is no longer necessary. Not only is the stability of the gem in the gem support increased, but also the aesthetic appearance of the article of jewelry is enhanced. In addition a reduction in the amount of jewelry material is achieved.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
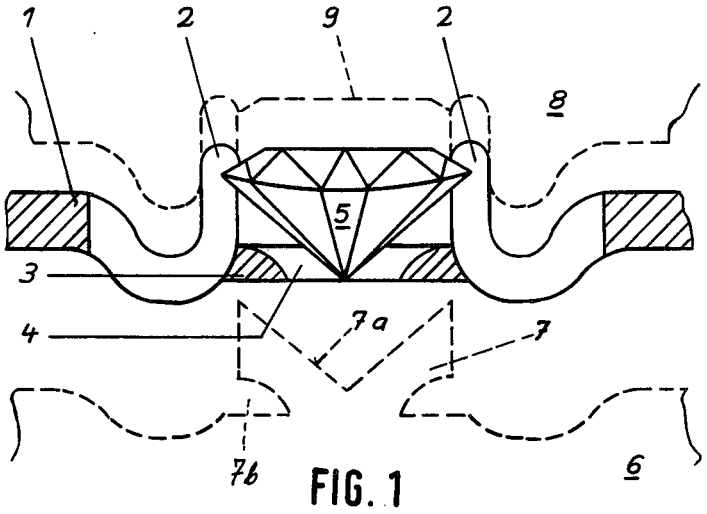
FIG. 1 is a broken-away diagrammatic side view, partly in section, of the wax copy of the metal body of the article of jewelry with an anchored gem obtained in the first mold by the method of the present invention.

Reference numerals 6 and 8 respectively identify juxtaposed mold sections having respective outer molding surfaces which are spaced from each other to thereby form a preform mold space. The molding surfaces of mold sections 6 and 8 have shaped contours which are complementary to the outer opposite surfaces of the final article of jewelry to be made by the method of the present invention. For example, if mold section 6 is the lower mold section, then its molding surface which consists of a plurality of projections and recesses is inversely related to the lower surface of the article of jewelry to be made; and if mold section 8 is the upper mold section, then its molding surface which likewise consists of a plurality of projections and recesses is inversely related to the upper surface of the article of jewelry to be formed. That is, mold sections 6 and 8 have respective negative patterns relative to the article of jewelry to be made.

In FIG. 1 mold section 6 has a projection 7 and a funnel-shaped recess *7a* in which the lower half of a gem 5 is positioned. Upper mold section 8 has a recess 9 in which the upper half of the gem 5 is mounted. The gem is thus supported intermediate the mold sections 6 and 8 in a predetermined orientation in the preform mold space.

Hardenable preform material, preferably a wax-like material, is thereupon introduced into the preform mold space, and the wax flows along different surface portions of the facets of the gem. The wax hardens about the gem 5 to thereby form a preform wax model 1 in which the gem 5 is fixedly anchored by the hardened preform wax material due to a slight but ever present shrinkage when the hardenable was cools.

The preform model 1 is shown in solid lines in FIG. 1, whereas the mold sections 6 and 8 are shown in dashed lines. The preform mold 1 has a plurality of upright supporting posts or stubs 2 (as shown in FIG. 2*a*) which tightly receive wedge-shaped portions of the gem 5. The stubs 2 are interconnected for stability by an annular base or footing 3. Footing 3 has a bore 4 bounded by side walls configurated to correspond to recesses *7b* of mold section 6. This type of setting is commonly known as a chaton-type setting. Due to the relatively large diameter of annular projection 7 and bore 4, a large amount of light strikes the gem and adds to the briliance of this particular setting.

The mold sections 6 and 8 are thereupon removed and the wax model 1, either alone or preferably with a plurality of other wax models for purposes of mass-production, and placed into a kuvette or treatment vessel. Thereupon, a hardenable embedding material is completely coated over the wax models. Upon hardening of the embedding material, a tight shell 18 is formed about each wax model 1. The shell 18 forms the mold sections of a mold cavity 17 which is presently filled with the wax-like substance and the supported gem 5.

The hardening of the embedding material in the treatment vessel is carried out in a known manner by heating the vessel in a heater. During the heating, the wax models melt down and are removed from the mold cavity. After this procedure, which takes several hours, the molten metal, preferably a precious metal, is introduced into the mold cavity. The molten metal flows into the space formerly occupied by the wax. Thus, when the molten metal cools and hardens, the metal stubs 2 surround facet portions of the gem 5 and fixedly anchor the latter in place.

The temperature of the molten metal is of course insufficient to melt the shell 18 constituted by hardened embedding material, as well as to melt the gem 5 itself. The embedding material is subsequently removed.

It is preferable if the preheating of the treatment vessel takes about four hours and the temperature does not exceed 500° C. The burning-in or hardening process of the embedding lasts approximately thirty minutes. Gems such as precious or semi-precious stones have been set in accordance with the method of the invention without being damaged at these temperatures. For example, diamonds, sapphires, rubies, garnets, aquamarine stones, topaz stones, and similar rock crystals, just to mention a few possibilities, may be used.

If the metal material is a gold alloy, then the molten temperature of this metal material is approximately 1100° C. Due to the relatively low temperature of the treatment vessel, which is less than 500° C. during the centrifugal casting operation, a relatively large temperature drop occurs between the molten metal and the casting of the article of jewelry. Cast structure is improved by quickly quenching the molten material. The treatment vessel is subsequently cooled to about 100° C. in a natural way, then the unfinished casting of the article of jewelry is removed in a conventional manner by breaking the shell of embedding material. The unfinished casting is subsequently machined and polished.

Figure 2:
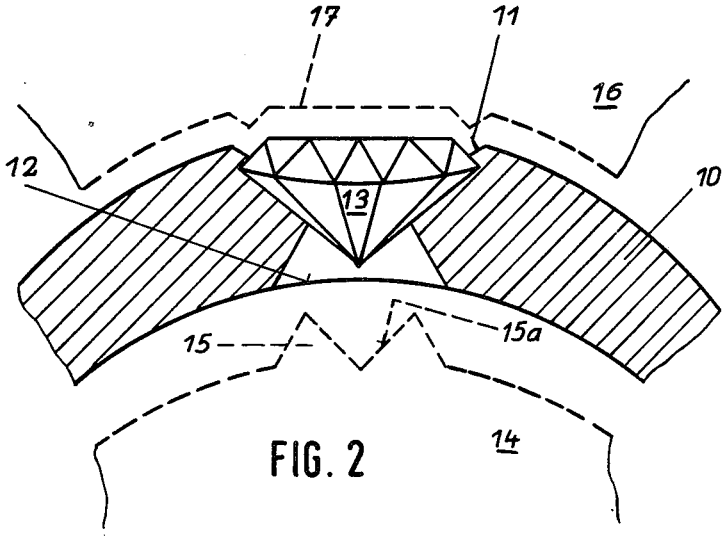
FIG. 2 is a broken-away diagrammatic side view of another type of setting obtained by the method of the present invention.
Figure 3:
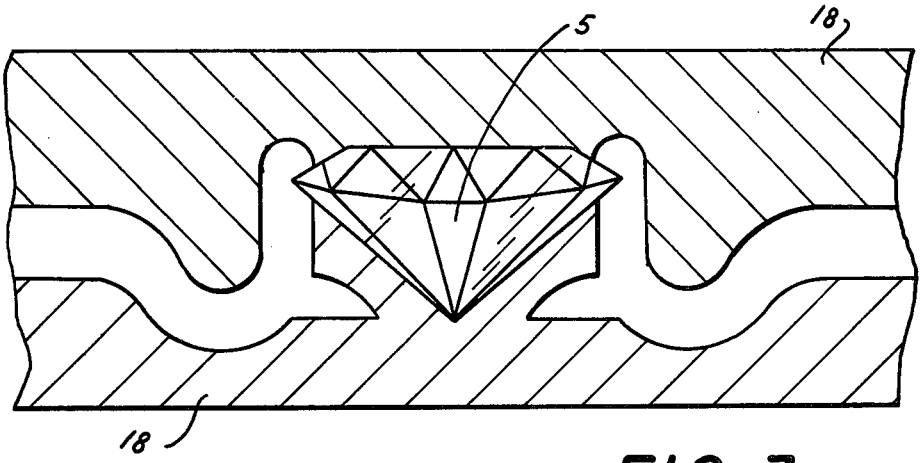
FIG. 3 is a side view, partly in section on the second mold of a temperature resistant material with the embedded gem according to FIG. 1, after the wax copy has been removed.
Figure 1A:
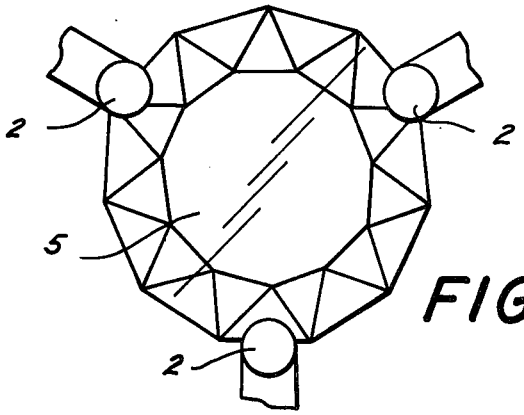
FIG. 1*a* is a broken-away plan view of the gem in a waxed copy according to FIG. 1.
Figure 2A:
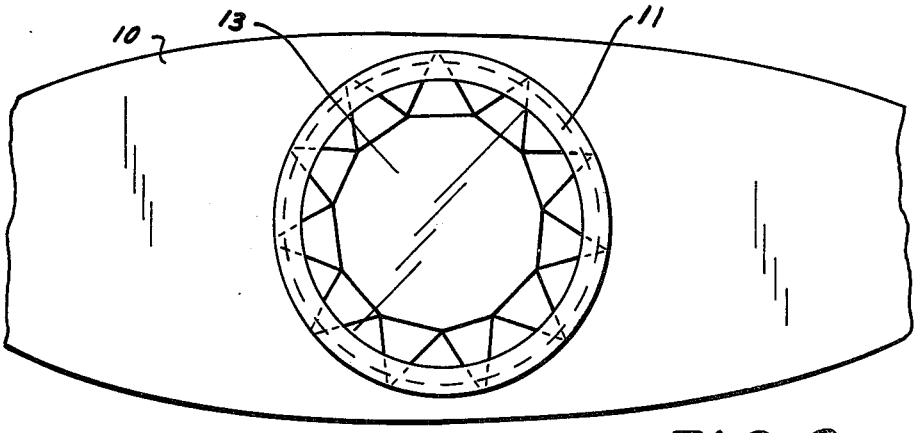
FIG. 2*a* is a plan view of the gem in a wax copy according to FIG. 2.

FIG. 2 shows another type of setting. Upper mold section 16 has a recess 17 for receiving the upper half of gem 13, and lower mold section 14 has a projection 15 and a recess 15*a* for supporting the lower half of gem 13.

The wax model 10, formed in a manner analogous to that described in connection with wax model 1 of FIG. 1, has a bore 12 and a lip or holding frame 11. The frame 11 has a wedge-shaped annular recess which receives the facet portions of the gem 13 and which anchors the latter as previously described. The overhanging lip 11 of the metallic article subsequently formed in the above-described shell 18 of embedding material of jewelry has no joint or seam which contributes to the aesthetic appearance of the finished article.

A common requirement in both disclosed settings is that the size of the gem to be set must be chosen within a relatively narrow tolerance range. This requires a sorting operation, particularly for high-grade, expensive articles of jewelry.

It will be understood that each of the elements described above, or two or more together, may also find a useful application in other types of methods, differing from the types described above.

While the invention has been illustrated and described as embodied in a jewelry article and method of setting gems therein, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of manufacturing articles of jewelry each including a body of precious metal with a gem set therein, comprising the steps of forming a sectional first mold surrounding a model of the article of jewelry, said first mold being formed of a pair of mold sections with respective molding surfaces which are respectively complementary to the outer opposite surfaces of said model; removing the model from the first mold and positioning a corresponding gem in its place in the first mold, said sections during the removal of said model being spaced apart from each other, said corresponding gem being positioned in one of said sections in a surface portion thereof complementary to the gem portion of said model, and thereafter said sections together with said corresponding gem being reassembled to form a preform space; pouring a hardenable wax-like material into said preform space, said hardenable wax-like material being introduced into supporting contact with the part of said gem that projects into said preform space to produce a wax-like copy of the body of the model with the corresponding gem anchored therein; removing the wax-like copy with the anchored gem from the first mold; applying a hardenable, temperature-resistant material about the wax-like copy with the anchored gem to form a second mold thereabout; burning-in the second mold at a temperature that is higher than the melting range of the wax-like copy but lower than that of the gem; removing the molten wax-like substance from the second mold while the gem remains embedded in the mold wall; filling the second mold with a molten precious metal encircling the exposed part of the embedded gem; and cooling the metal to solidify and removing the resulting article of jewelry from the second mold.

2. A method as defined in claim 1, wherein said second mold is burned-in at a temperature of about 500° C. and the molten precious metal is introduced into the burned-in second mold at a temperature in the range of 1100° C.

3. A method as defined in claim 2, wherein said article of jewelry is cooled in said second mold to a temperature of about 100° C.

4. A method as defined in claim 1, wherein said sectional first mold is of resilient rubber-like material.

* * * * *